US006029370A

United States Patent [19]

Cromeens

[11] Patent Number: 6,029,370

[45] Date of Patent: Feb. 29, 2000

[54] SYSTEM AND METHOD FOR DRYING SLUDGE USING LANDFILL GAS

[76] Inventor: Steve Cromeens, 16350 Blanco Rd., Suite 117-114, San Antonio, Tex. 78232

[21] Appl. No.: 08/993,462

[22] Filed: Dec. 3, 1997

Related U.S. Application Data

[60] Provisional application No. 60/032,406, Dec. 4, 1996.

[51] Int. Cl.[7] ..... F26B 3/00

[52] U.S. Cl. ..... 34/443; 34/487; 34/513

[58] Field of Search ..... 34/329, 334, 338, 34/362, 181, 187, 443, 487, 513; 432/14, 262

[56] References Cited

U.S. PATENT DOCUMENTS 5,954,970 9/1999 St. Louis ..... 210/710

*Primary Examiner*—Henry Bennett
*Assistant Examiner*—Malik N. Drake
*Attorney, Agent, or Firm*—Jenkens & Gilchrist

[57] ABSTRACT

A system and method using landfill gas to dry wet sludge to inexpensively produce fertilizer or dry waste for disposal, while acting to conserve natural gas resources. The system and method are expected to provide dry sludge as an end product at approximately one-fifth of the cost of conventional methods.

22 Claims, 1 Drawing Sheet

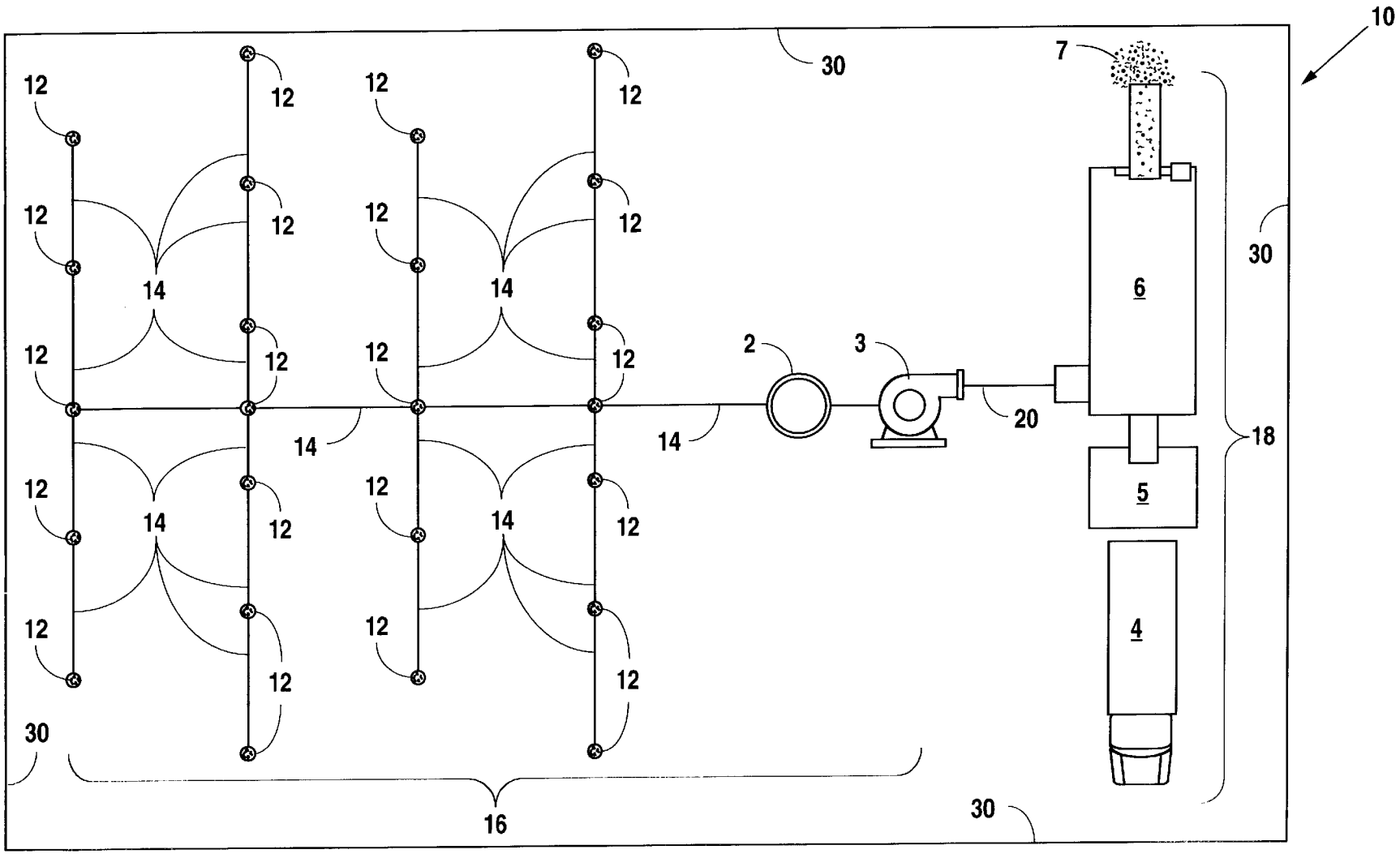
10
30
18
6
5
4
7
20
3
2
14
12
16

SYSTEM AND METHOD FOR DRYING SLUDGE USING LANDFILL GAS

This application claims the benefit under Title 35 United States Code §119(e) of U.S. Provisional Application No. 60/032,406, filed Dec. 4, 1996.

BACKGROUND OF THE INVENTION

1. Technical Field

The present invention relates to a system and method for drying industrial sludge using natural gas as the primary energy source. More specifically, the invention relates to a system and method using landfill gas as an energy source to dry industrial sludge, including that provided by landfill or wastewater processing, for fertilizer production, or to reduce the cost of waste disposal.

2. History of Related Art

Extracting natural gas from landfills is becoming more common throughout the United States due to new regulations set out by the EPA. While landfill gas has been used to generate electricity and in other industrial applications (e.g. boiler operation), it is typically not transported through the national gas pipeline system, due to the large amount of $CO_2$ present (i.e., landfill gas is typically composed of 50% methane and 50% $CO_2$). Therefore, most of the gas produced at landfills is flared to the atmosphere to destroy any harmful compounds (e.g., methane, which depletes the ozone layer, and various carcinogens, such as $H_2S$) that might be present, completely wasting the landfill gas energy potential.

Waste management professionals are constantly looking for ways to properly dispose of waste water and industrial sludge (sewage or landfill). Because of the limitations on, and cost of, landfill space, as well as the potential contamination liability brought about by the escape of liquids within the wet sludge to surrounding areas, the drying of such sludge is rapidly becoming a preferred disposal choice. Once the sludge is dried, it can be disposed at a much lower cost, or used as fertilizer to replenish minerals depleted by crop and landscape growth. However, one of the major expenses incurred by drying sludge is the cost of the energy used to generate the heat. Because landfill gas can be produced and sold for a fraction of the cost of pipeline natural gas, the present invention provides a system which combines the use of normally wasted landfill gas for use as an inexpensive energy source to dry sludge.

Therefore, the present invention provides a system which collects gas from a landfill and makes it available as an energy source to dry wet sludge, producing inexpensive fertilizer or dried waste for disposal, and operating to conserve natural gas resources.

SUMMARY OF THE INVENTION

In accordance with one aspect of the present invention, a system for drying wet sludge using landfill gas comprises a means for collecting landfill gas from a landfill, a means for transporting the collected landfill gas, and a means for drying the wet sludge, wherein the drying means is fueled by the collected landfill gas.

Other features of the system for drying wet sludge using landfill gas include a gas well or pipeline system used to collect the landfill gas. The collected landfill gas can be transported using a gas pipeline system augmented by a pressure blower or compressor. This system is designed to operate using landfill gas which is comprised of up to about 50% methane and up to 50% carbon dioxide. The wet sludge can be taken from a sewage processing plant, a waste water processing plant, or from a landfill. The means for drying the wet sludge may be fed by a bulk wet sludge bin, which in turn may be filled by a sludge haul truck, or taken directly from a waste water treatment plant as a processing byproduct.

In accordance with the method of the present invention, wet sludge may be dried using landfill gas by collecting the landfill gas from the landfill, transporting the collected landfill gas to a drying means, and drying the wet sludge using the drying means fueled by the collected landfill gas.

Other features of the method include accomplishing the collecting step using a gas well. The transporting step may be accomplished by using a gas pipeline system augmented by a pressure blower or compressor. The drying means may comprise a gas-fired sludge dryer. The method is directed toward utilizing landfill gas which may comprise up to about 50% methane and up to about 50% carbon dioxide. In accomplishing the steps of the method, the wet sludge may be taken from a sewage processing plant, a waste water processing plant, or directly from a landfill. Also, the method may be accomplished by feeding the drying means from a bulk wet sludge bin, which in turn is filled with sludge by a sludge haul truck, or taken directly from a waste water treatment plant as a processing byproduct.

BRIEF DESCRIPTION OF THE DRAWING

The FIGURE is a block diagram of a system for drying wet sludge using landfill gas.

DETAILED DESCRIPTION OF PRESENTLY PREFERRED EXEMPLARY EMBODIMENTS

Reference is made to the FIGURE for a description of the system of the present invention. The FIGURE depicts an embodiment of the system 10 for drying sludge using landfill gas. The system 10 comprises a landfill gas extraction and collection subsystem 16, a sludge drying subsystem 18, and a landfill gas delivery subsystem 20. The landfill gas collection subsystem 16 is commonly known in the art. The landfill gas collection subsystem 16 consists of a number of landfill gas collectors 12, such as gas wells, dispersed within the landfill boundary 30. The gas collectors 12 are interconnected by pathways 14 (e.g. gas pipeline) which transport the collected gas to a gas condensate knock-out device 2, such as the knock-out tanks manufactured by CSR Pipeline Systems of Gainesville, Tex. The gas condensate knock-out device 2 eliminates most of the liquid condensate which may exist in the collected gas by allowing the gas to expand and cool before retransmission. The collected gas is then passed to a gas compressor/blower 3, such as the single stage pressure blower (e.g. Design #53 manufactured by Chicago Blower), for delivery of the gas.

At this point, the collected gas is passed to a landfill gas delivery subsystem 20. This landfill gas delivery subsystem 20 may be a gas pipeline permitting delivery of the collected gas directly to the sludge drying subsystem 18. Or, the landfill gas delivery subsystem 20 may be located near the landfill, and used to provide access to the gas as needed. The stored gas is then moved via conventional methods to the sludge drying subsystem 18.

The sludge drying subsystem 18 consists of at least one landfill-gas fired sludge dryer 6 into which bulk wet sludge is fed from a bulk wet sludge bin 5. The bulk wet sludge bin 5 is filled with wet sludge either directly from a waste water processing system (not shown) or via a sludge haul truck 4 which brings the wet sludge in from a remote site. The bulk wet sludge which enters the sludge dryer 6 is mechanically driven through the dryer 6, which is heated by the collected landfill gas. The dryer 6 may be heated directly or indirectly. As is known in the waste-handling industry, the gas-fired dryer is typically a mechanical dryer, such as those sold by Fenton Environmental to utilities for processing waste, and the sludge is mechanically driven through the dryer 6 until its original moisture content level is reduced from about 80% to meet a predetermined level, typically less than about 15%. The system 10 is expected to produce dry sludge 7 at about one-fifth the cost of conventional methods.

While the invention has been particularly shown and described with reference to specific embodiments thereof, it will be understood by those skilled in the art that various changes in form and detail may be made thereto, and that other embodiments of the present invention beyond those embodiments specifically described herein may be made or practiced without departing from the spirit and scope of the present invention as limited solely by the appended claims.

What I claim is:

1. A system for drying wet sludge using landfill gas, said system comprising:

means for collecting landfill gas from a landfill;

means for transporting said collected landfill gas; and means for drying said wet sludge, wherein said means for drying is fueled by said collected landfill gas.

2. The system set forth in claim 1, wherein said means for collecting landfill gas is a gas well.

3. The system set forth in claim 1, wherein said means for transporting said collected landfill gas is a gas pipeline system augmented by a pressure blower.

4. The system set forth in claim 1, wherein said means for transporting said collected landfill gas is a gas pipeline system augmented by a compressor.

5. The system set forth in claim 1, wherein said means for drying said wet sludge is a gas-fired sludge dryer.

6. The system set forth in claim 1, wherein said wet sludge is taken from a sewage processing plant.

7. The system set forth in claim 1, wherein said wet sludge is taken from a waste water processing plant.

8. The system set forth in claim 1, wherein said wet sludge is taken from a landfill.

9. The system set forth in claim 1, wherein said means for drying said wet sludge is fed by a bulk wet sludge bin.

10. The system set forth in claim 9, wherein said wet sludge is moved to said bulk wet sludge bin by a sludge haul truck.

11. The system set forth in claim 9, wherein said wet sludge is moved to said bulk wet sludge bin as a byproduct of wastewater treatment.

12. A method for drying wet sludge using landfill gas, said method comprising the steps of:

collecting landfill gas from a landfill;

transporting said collected landfill gas to a drying means; and drying said wet sludge using the drying means fueled by said collected landfill gas.

13. The method set forth in claim 12, wherein said collecting step is accomplished by a gas well.

14. The method set forth in claim 12, wherein said transporting step is accomplished by a gas pipeline system augmented by a pressure blower.

15. The method set forth in claim 12, wherein said transporting step is accomplished by a gas pipeline system augmented by a compressor.

16. The method set forth in claim 12, wherein said drying step is accomplished by a gas-fired sludge dryer.

17. The method set forth in claim 12, wherein said wet sludge is taken from a sewage processing plant.

18. The method set forth in claim 12, wherein said wet sludge is taken from a waste water processing plant.

19. The method set forth in claim 12, wherein said wet sludge is taken from a landfill.

20. The method set forth in claim 12, wherein said means for drying said wet sludge is fed by a bulk wet sludge bin.

21. The method set forth in claim 20, wherein said wet sludge is moved to said bulk wet sludge bin by a sludge haul truck.

22. The method set forth in claim 20, wherein said wet sludge is moved to said bulk wet sludge bin as a byproduct of wastewater treatment.

* * * * *